US007306269B2

(12) United States Patent
Cetnar et al.

(10) Patent No.: US 7,306,269 B2
(45) Date of Patent: Dec. 11, 2007

(54) LOCK FOR A DOOR OF A MOTOR VEHICLE

(75) Inventors: Roman Cetnar, Newmarket (CA); Franco Giovanni Ottino, San Giuliano Terme (IT)

(73) Assignee: Intier Automotive Closures S.p.A., Cascine Vica Rivoli (IT)

( * ) Notice: Subject to any disclaimer, the term of this patent is extended or adjusted under 35 U.S.C. 154(b) by 0 days.

(21) Appl. No.: 10/517,955

(22) PCT Filed: Jun. 13, 2003

(86) PCT No.: PCT/IT03/00369

§ 371 (c)(1),
(2), (4) Date: Aug. 10, 2005

(87) PCT Pub. No.: WO03/106793

PCT Pub. Date: Dec. 24, 2003

(65) Prior Publication Data

US 2006/0097523 A1 May 11, 2006

(30) Foreign Application Priority Data

Jun. 14, 2002 (IT) ..... TO2002A0512

(51) Int. Cl.
*E05B 15/02* (2006.01)
*E05C 19/10* (2006.01)

(52) U.S. Cl. ..... 292/341.12; 292/216; 292/340; 292/341.11; 292/DIG. 57; 292/DIG. 73

(58) Field of Classification Search ..... 292/216, 292/201, 340, 341.11, 341.12, 341.13, DIG. 57, 292/DIG. 73, 100
See application file for complete search history.

(56) References Cited

U.S. PATENT DOCUMENTS

| | | | | | |
|---|---|---|---|---|---|
| 2,504,510 | A | * | 4/1950 | Ernest | 49/440 |
| 3,848,911 | A | | 11/1974 | Watermann et al. | |
| 3,876,238 | A | * | 4/1975 | Watermann | 292/216 |
| 3,997,202 | A | * | 12/1976 | Tack et al. | 292/216 |
| 4,097,078 | A | * | 6/1978 | Tack et al. | 292/216 |
| 4,130,308 | A | * | 12/1978 | Jeavons | 292/216 |
| 4,165,112 | A | * | 8/1979 | Kleefeldt | 292/216 |
| 4,733,892 | A | * | 3/1988 | Kleefeldt et al. | 292/216 |
| 4,941,696 | A | * | 7/1990 | Yamada et al. | 292/340 |

(Continued)

FOREIGN PATENT DOCUMENTS

DE 22 11 161 9/1973

(Continued)

*Primary Examiner*—Jennifer H. Gay
*Assistant Examiner*—Carlos Lugo
(74) *Attorney, Agent, or Firm*—Clark Hill PLC

(57) ABSTRACT

A lock is provided for a door of a motor vehicle. The lock includes a closing mechanism designed for coupling with a lock striker along a direction of relative coupling. The closing mechanism includes a supporting body having a housing seat for receiving an engagement portion of the lock striker. An elastically compliant buffer delimits the housing seat at least in the aforesaid direction of relative coupling in order to define a damped arrest of the engagement portion of the lock striker. The buffer is coated on its surface, in an area of interaction with the engagement portion of the lock striker by a rigid protective shield. The shield is fixedly secured to the buffer.

13 Claims, 1 Drawing Sheet

U.S. PATENT DOCUMENTS 5,064,229 A * 11/1991 Hamada et al. ..... 292/216
5,141,270 A * 8/1992 Shibata ..... 292/216
5,209,531 A * 5/1993 Thau ..... 292/216
5,209,532 A * 5/1993 Nakamura et al. ..... 292/216
5,309,745 A * 5/1994 Ursel et al. ..... 70/264
5,348,355 A * 9/1994 Oyha ..... 292/11
5,505,506 A * 4/1996 Kleefeldt ..... 292/337
5,727,825 A 3/1998 Spurr
5,785,365 A * 7/1998 Lorey ..... 292/216
5,918,918 A 7/1999 Mosley
6,322,114 B1 * 11/2001 Kurachi et al. ..... 292/341.17
2006/0006680 A1 * 1/2006 Johansen et al. ..... 292/340

FOREIGN PATENT DOCUMENTS

| | | | |
|---|---|---|---|
| DE | 22 20 677 | | 11/1973 |
| EP | 995870 | * | 4/2000 |
| FR | 2 498 238 | | 7/1982 |
| FR | 2 786 524 | | 6/2000 |
| GB | 1436996 | * | 5/1996 |
| JP | 09189161 | * | 7/1997 |
| JP | 02176084 | * | 7/1999 |

* cited by examiner

LOCK FOR A DOOR OF A MOTOR VEHICLE

TECHNICAL FIELD

The present invention relates to a lock for a door of a motor vehicle.

It is pointed out that the term "door" is used, in the present description and in the ensuing claims, in its widest sense to indicate any element that can move between an opening position and a closing position of an access opening to an internal compartment of a motor vehicle. The aforesaid term therefore comprises the side doors of the motor vehicle, the bonnet or the boot or the hatchback.

BACKGROUND ART

As is known, closing systems for doors of motor vehicles basically comprise a lock mounted on the door and a lock striker mounted in a fixed portion of the bodywork in the proximity of the opening of the door itself (or, more rarely, vice versa).

The lock comprises a closing mechanism designed to co-operate with the lock striker so as to obtain a relative blocking between the lock and the lock striker itself when the door is closed.

Currently, there is a widespread use of lock strikers of the type comprising a U-shaped element having opposite ends riveted onto a supporting plate. The U-shaped element is basically made up of two cylindrical portions, which extend orthogonally from the supporting plate and are radiused, on the opposite side, by a connecting portion set transverse to them.

The closing mechanism comprises a fork and a pawl which are hinged to respective pins fixed to a supporting body designed to be fixed to the door of the motor vehicle.

The fork is designed to couple in a releasable way with one of the cylindrical portions of the lock striker, hereinafter referred to as "engagement portion", whilst the pawl is designed to block the fork, in a releasable way, in a position of closing on the lock striker.

In particular, the supporting body and the fork define respective U-shaped seats for housing and blocking the engagement portion of the lock striker. Each of said seats defines, at one end, an entry section for the engagement portion of the lock striker and is delimited, at an opposite end, by a bottom wall, which defines the position of arrest of said engagement portion.

The fork is pushed by a corresponding spring in the direction of an opening position, in which it presents the entry section of its own seat facing the same part of the entry section of the seat of the supporting body so as to enable introduction and extraction of the engagement portion of the lock striker in/from said seats. The said fork can be turned about its own pin in order to assume the aforesaid closing position, in which a portion of the side edge of the seat intercepts the seat of the supporting body so as to block the engagement portion of the lock striker within the seats themselves.

The pawl is designed to couple by snap action with the peripheral edge of the fork in order to block the fork itself, in a releasable way, in the closing position, and is loaded by a corresponding spring in the direction of said peripheral edge.

Typically, entry of the engagement portion of the lock striker into the seat of the supporting body is guided by the walls that delimit the seat itself at the sides, the said walls presenting a profile that converges in the direction of the bottom wall.

In order to reduce the noise produced by coupling between the lock striker and the lock, there are currently adopted constructional solutions based mainly upon the use of a buffer or damper, which is typically made of rubber and is set inside the seat of the supporting body and is coupled to the bottom wall of the seat itself so as to define a damped striking arrest for the engagement portion of the lock striker.

On account of the curvilinear conformation of the engagement portion of the lock striker, distribution of the contact pressures between the external surfaces of the engagement portion and of the buffer is not uniform. In particular, the contact pressure is maximum in an area corresponding to an intermediate portion of the buffer and decreases markedly towards the opposite side edges of the latter.

Over time, this may cause tearing of the buffer, with adverse effects on retention of the lock striker and on the damping action performed by the buffer. Furthermore, this phenomenon may cause an undesired increase in play between the dimensions of the door and the corresponding opening for receiving the door, which is provided in the bodywork of the motor vehicle, with consequent generation of noise and possible rattling of the door when the vehicle is travelling.

SUMMARY OF THE INVENTION

The purpose of the present invention is to provide a lock for a door of a motor vehicle, which will enable, in a simple and inexpensive way, to reduce the noise generated by coupling between the lock itself and the corresponding lock striker.

According to the present invention, a lock is provided for a door of a motor vehicle. The lock includes a closing mechanism designed for coupling with a lock striker along a direction of relative coupling. The closing mechanism includes a supporting body having a housing seat for receiving an engagement portion of the lock striker. An elastically compliant buffer delimits the housing seat at least in the aforesaid direction of relative coupling in order to define damped arrest of the engagement portion of the lock striker. The buffer is coated on its surface, in an area of interaction with the engagement portion of the lock striker, by a rigid protective shield. The shield is fixedly secured to the buffer.

BRIEF DESCRIPTION OF THE DRAWINGS

For a better understanding of the present invention, there follows a description of a preferred embodiment, provided purely by way of non-limiting example, and with reference to the attached drawings, in which.

BEST MODE FOR CARRYING OUT THE INVENTION

Figure 1:
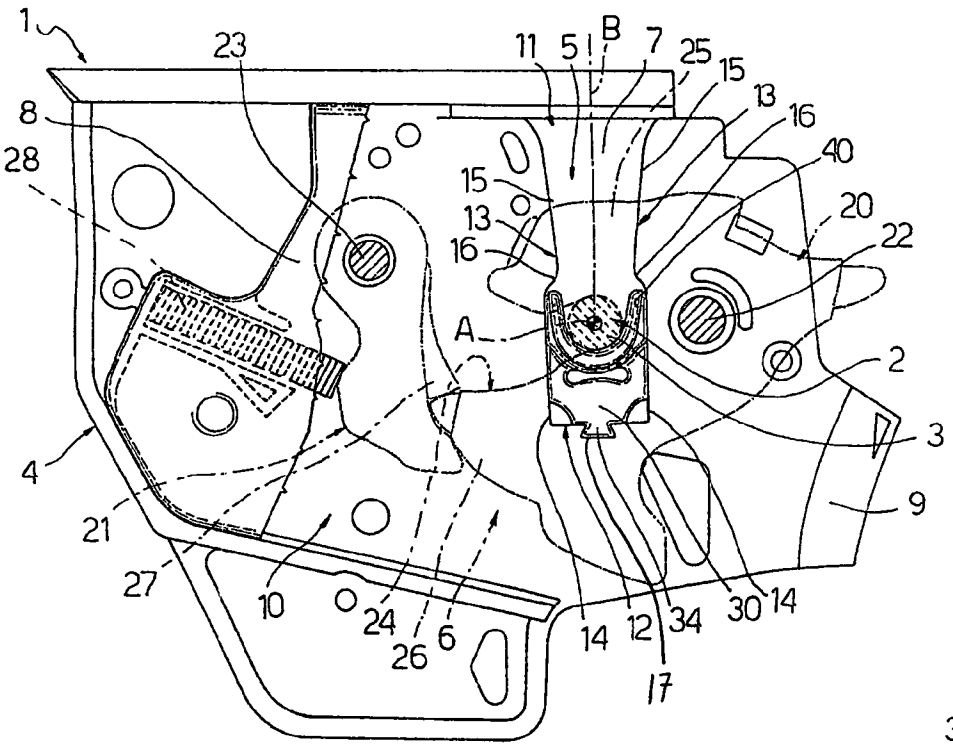
FIG. 1 is a top plan view, with parts removed for reasons of clarity, of a lock for a door of a motor vehicle built according to the present invention and coupled with a fixed lock striker.

With reference to FIG. 1, the number 1 designates, as a whole, a lock built according to the present invention.

The lock 1 is designed to be mounted on the door (not illustrated) of a motor vehicle (not illustrated) and to couple to a fixed lock striker 2, which is fixed to an upright of the body of the motor vehicle (not illustrated) to provide for closing of the door. The lock striker 2 is illustrated in just one of its portions 3 that interacts with the lock, the said portion presenting a cylindrical conformation with axis A.

The lock 1 comprises a supporting body 4 having a box-like shape and designed to be rigidly fixed, in a known way, to the door of the motor vehicle and having a substantially U-shaped opening 5 for receiving the portion 3 of the lock striker 2, and a closing mechanism 6 (illustrated with a dashed and dotted line to render visible the parts of the supporting body 4 underlying it), which is set inside the supporting body 4 and is designed to couple, via the opening 5 and in a way in itself known, with the portion 3 of the lock striker 2 along a direction B of relative coupling transverse to the axis A for achieving closing of the door of the vehicle.

In particular, the supporting body 4 comprises a pair of plates 7, 8 made of metal material, which are substantially plane and are set facing one another and parallel to one another, and a shell 9 made of plastic material set between the plates 7, 8 and defining, inside, an opening 10, which communicates with the outside through the opening 5 and in which there is set the closing mechanism 6.

The opening 5 is made through the plate 8 and the shell 9 of the supporting body 6 and defines, at one end, an entry area 11 for the portion 3 of the lock striker 2. The opening 5 is delimited, at an end opposite to the entry area 11, by a bottom wall 12 orthogonal to the direction B and, laterally, by a pair of walls 13 set transverse to the wall 12. More precisely, the walls 13 have first plane portions 14 extending orthogonally from respective end edges of the bottom wall 12, and second plane and oblique portions 15, which diverge with respect to one another starting from the portions 14 and which form with the portions 14 respective projections 16 facing towards the inside, of the opening 5. Consequently, the opening 5 has, starting from the entry area 11, a section that decreases progressively towards the area of the projection 16, from which it widens out sharply towards the portions 14 of the walls 13 to assume, along the portions 14, a constant cross section.

The closing mechanism 6 comprises, in a known way, a fork 20 and a pawl 21 hinged to respective pins 22, 23, which extend between the plates 7 and 8 and are set on opposite sides of the opening 5. The pins 22, 23 are rigidly fixed to the plates 7, 8 and have respective axes parallel to the axis A of the portion 3 of the lock striker 2 and orthogonal to the plates 7 and 8.

The fork 20 is formed by a shaped metal plate coated with plastic material, is hinged at one of its own intermediate portions to the pin 22, and has a U-shaped peripheral seat 24 designed for being engaged by the portion 3 of the lock striker 2 and delimited laterally by a pair of teeth 25, 26.

The fork 20 is normally maintained by a spring (not illustrated) in an opening position (not illustrated either), in which it presents its own seat 24 oriented on the same side as the opening 5 of the supporting body 4 so as to enable engagement and disengagement of the portion 3 of the lock striker 2.

Under the thrust of the lock striker 2 and following upon slamming of the door, the fork 20 rotates about the axis of its own pin 22 from the opening position to a closing position (FIG. 1), where the portion 3 of the lock striker 2 is blocked in the seat 24, and the tooth 25 intercepts the opening 5 in a known way, preventing it from coming out.

The pawl 21 is formed by a shaped metal plate, which is coated with plastic material and extends on the same plane of lie as the fork 20 and at one side of the latter. The pawl 21 has an L-shaped lateral projection 27, which is designed for snap coupling with the tooth 26 of the fork 20 so as to block the fork 20 in a releasable way in the closing position.

The pawl 21 is pushed, in a known way, in the direction of the fork 20 by a cylindrical helical spring 28 acting against one side of the pawl 21 opposite to the side from which the projection 27 extends.

Advantageously, inside the opening 5 of the supporting body 4, between the area of the projections 16 and the bottom wall 12, is housed a pad or buffer 30, made of elastically compliant material and defining a damped arrest for the portion 3 of the lock striker 2 so as to reduce the noise produced by the coupling between the lock striker 2 and the lock 1.

In particular, the buffer 30 is formed by a substantially prismatic block or pad made of elastomeric material having an end surface 31 set so that it bears upon the bottom wall 12 of the opening 5 and opposite lateral surfaces 32 set so that they bear upon the respective walls 13 of the opening 5.

Figure 2:
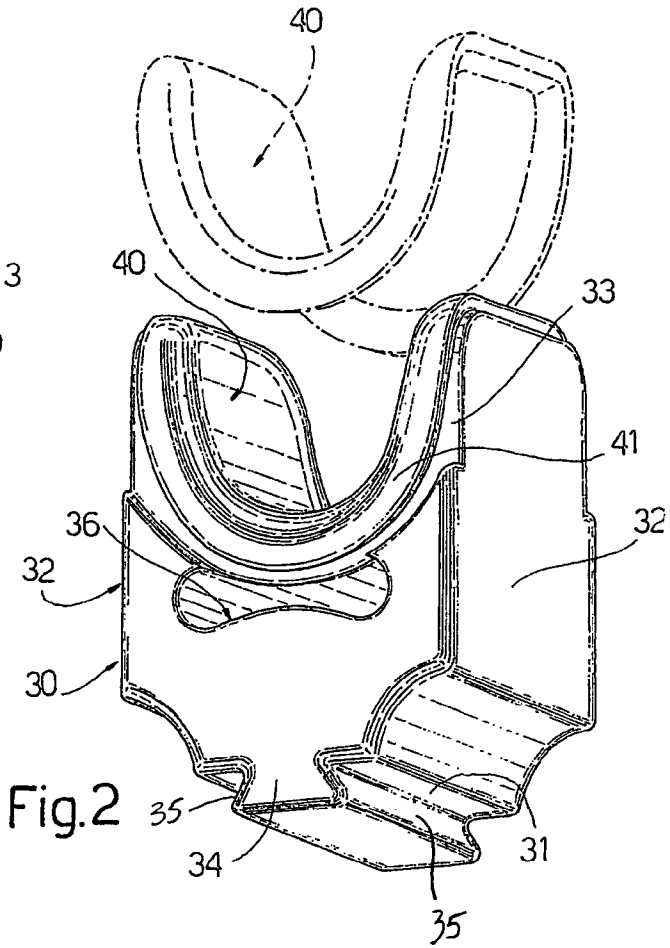
FIG. 2 is a perspective view, at an enlarged scale, of a damping buffer of the lock illustrated in FIG. 1 for receiving the lock striker.

The buffer 30 (see FIG. 2) is delimited, on the opposite side of the end surface 31, by an end edge 33 for receiving the portion 3 of the lock striker 2, the said end edge having an arched and concave conformation.

Coupling of the buffer 30 with the supporting body 4 is obtained by coupling of a projection 34, which extends in cantilever fashion from the end surface 31 of the buffer 30 with a groove or recess 17 having a complementary conformation made in the bottom wall 12 of the opening 5. As may be seen from FIG. 1, in order to ensure retention of the buffer 30 in the direction B, the projection 34 has opposite lateral edges 35 that are oblique and converge with respect to one another towards the end surface 31.

Coupling of the buffer 30 with the supporting body 4 is obtained by coupling of a projection 34, which extends in cantilever fashion from the end surface 31 of the buffer 30 with a groove or recess 17 having a complementary conformation made in the bottom wall 12 of the opening 5. As may be seen from FIG. 1, in order to ensure retention of the buffer 30 in the direction B, the projection 34 has opposite lateral edges 35 that are oblique and converge with respect to one another towards the end surface 31.

The buffer 30 further has, in an intermediate position, a slot 36, which is elongated in a direction transverse to the lateral walls of the opening 5, the said slot 36 being designed to enable elastic bending of the end edge 33 of the buffer 30 during impact with the portion 3 of the lock striker 2.

According to an important characteristic of the present invention, the end edge 33 of the buffer 30 is coated on the surface by a rigid protective shield or plate 40, which has the function of enabling an even distribution of the impact load of the portion 3 of the lock striker 2 over the entire surface of the end edge 33, thus eliminating any risk of tearing of the buffer 30.

The shield or plate 40 is also U-shaped and has opposite lateral edges 41 folded around the buffer 30. In particular, the plate 40 is fixedly secured to the second end 33 of the buffer 30 by forcing the opposite lateral edges 41 of the plate 40 around the buffer 30. For ease of installation, the shield 40 can be fixedly secured to the second end 33 of hte buffer 30 prior to couping of the buffer 30 with the supporting body 4 such that the buffer 30 and shield 40 are a one-poece component.

According to a preferred embodiment of the present invention, the plate 40 has, in the area of interaction with the portion 3 of the lock striker 2, a surface coating made of ceramic material with a low coefficient of friction. The said coating prevents generation, while the motor vehicle is travelling, of any squeaking deriving from the possible relative sliding between the portion 3 of the lock striker 2 and the plate 40 in the direction of the axis A.

Finally, it is clear that modifications and variations can be made to the lock 1 described and illustrated herein, without thereby departing from the sphere of protection of the present invention.

The invention claimed is:

1. A lock (1) for a door of a motor vehicle comprising:

a closing mechanism (6) designed for coupling with a lock striker (2) along a direction (B) of relative coupling;

a supporting body (4) of said closing mechanism (6) having a housing seat (5) for an engagement portion (3) of said lock striker (2); said housing seat (5) having an entry area (11) for said engagement portion (3) and being delimited:

laterally, by a pair of opposing side walls (13), and at an end opposite to said entry area (11), by a bottom wall (12) orthogonal to said direction (B) of relative coupling;

an elastically compliant buffer (30) including a first end (31) coupled to said bottom wall (12) retaining said buffer (30) in said housing seat (5), and a second end (33) having a concave surface for receiving an impact from said engagement portion (3) of said lock striker (2) and delimiting said housing seat (5) in said direction (B) of relative coupling in order to define damped arrest of said lock striker (2); and a rigid protective shield (40) covering said second end (33) of said buffer (30) in an area of interaction with said engagement portion (3) of said lock striker (2) for evenly distributing said impact of said lock striker (2) over said second end (33) wherein opposite lateral edges (41) of said shield (40) are folded around said second end (33) of said buffer (30) thereby fixedly securing said shield (40) to said buffer (30).

2. The lock according to claim 1, characterized in that said buffer (30) includes a projection (34) extending from said first end (31) disposed in a recess (17) formed in said bottom wall (12) of said housing seat (5) coupling said buffer (30) to said bottom wall (12).

3. The lock according to claim 2, characterized in that said projection (34) is defined by opposite lateral edges (35) converging with respect to one another toward said first end (31).

4. The lock according to claim 3, characterized in that said buffer (30) includes opposite lateral surfaces (32) bearing upon said side walls (13).

5. The lock according to claim 4, characterized in that said buffer (30) includes a slot (36) disposed between said first end (31) and said second end (33), said slot (36) extending transversely to said side walls (13).

6. The lock according to claim 5, characterized in that said buffer (30) and said shield (40) are generally U-shaped in said area of interaction with said engagement portion (3) of said lock striker (2).

7. The lock according to claim 6, characterized in that said buffer (30) is made of an elastomeric material.

8. The lock according to claim 6, characterized in that said shield (40) has, in said area of interaction with said engagement portion (3) of said lock striker (2), a surface coating of ceramic material.

9. The lock according to claim 1, characterized in that said shield (40) is fixedly secured to said buffer (30) by forcing said opposite lateral edges (41) of said shield (40) around said second end (33) of said buffer (30).

10. A lock (1) for a door of a motor vehicle comprising:

a closing mechanism (16) adapted for coupling with a lock striker (2) along a direction (B) of relative coupling;

a supporting body (4) of said closing mechanism (6) including an opening (5) for receiving a lock striker (2) therein, said opening (5) including a pair of opposing side walls (13) extending between an entry area (11) and an opposite bottom wall (12) orthogonal to said direction (B) of relative coupling;

an elastically compliant buffer (30) including a first end (31) coupled to said bottom wall (12) by a projection (34) extending from said first end (31) and having opposite lateral edges (35) converging with respect to one another toward said first end (31) and disposed in a recess (17) formed in said bottom wall (12), opposite lateral surfaces (32) bearing upon said side walls (13), a second end (33) having a concave surface for receiving an impact from an engagement portion (3) of said lock striker (2) and delimiting said opening (5) in said direction (B) of relative coupling in order to define damped arrest of said lock striker (2), and a slot (36) disposed between said first end (31) and said second end (33) and extending transversely to said side walls (13); and a rigid protective shield (40) covering said second end (33) of said buffer (30) in an area of interaction with said engagement portion (3) of said lock striker (2) for evenly distributing said impact of said lock striker (2) over said second end (33) wherein opposite lateral edges (41) of said shield (40) are folded around said second end (33) of said buffer (30) thereby fixedly securing said shield (40) to said buffer (30).

11. The lock according to claim 10, characterized in that said buffer (30) and said shield (40) are generally U-shaped in said area of interaction with said engagement portion (3) of said lock striker (2).

12. The lock according to claim 11, characterized in that said shield (40) has a surface coating of ceramic material in said area of interaction with said engagement portion (3) of said lock striker (2).

13. The lock according to claim 12, characterized in that said buffer (30) is made of an elastomeric material.

* * * * *